United States Patent [19]

Muir et al.

[11] Patent Number: 4,559,209

[45] Date of Patent: Dec. 17, 1985

[54] LEACHING REFRACTORY GOLD ORES

[75] Inventors: Colin W. A. Muir, Sandton; Leonard P. Hendriks, Germiston, both of South Africa

[73] Assignee: Johannesburg Consolidated Investment Company Limited, Germiston, South Africa

[21] Appl. No.: 529,587

[22] Filed: Sep. 6, 1983

[30] Foreign Application Priority Data

Oct. 25, 1982 [ZA] South Africa ..... 82/7780

[51] Int. Cl.[4] ..... C01G 3/00

[52] U.S. Cl. ..... 423/30; 423/87; 75/101 R; 75/105; 75/118 R

[58] Field of Search ..... 423/29, 30, 31, 87; 75/101 R, 105, 118 R

[56] References Cited

U.S. PATENT DOCUMENTS

| | | | |
|---|---|---|---|
| 732,639 | 6/1903 | Joseph | 423/30 |
| 801,470 | 10/1905 | Merrill | 423/30 |
| 1,002,447 | 9/1911 | Porter | 423/30 |
| 1,198,011 | 9/1916 | Crowe | 423/30 |
| 4,401,468 | 8/1983 | Henderson | 423/30 |
| 4,438,076 | 3/1984 | Pietsch et al. | 423/31 |

*Primary Examiner*—John Doll
*Assistant Examiner*—Robert L. Stoll
*Attorney, Agent, or Firm*—Kuhn, Muller and Bazerman

[57] ABSTRACT

A method is disclosed for leaching a gold ore which is refractory due to the presence of sulphide minerals of arsenic and antimony. The ground ore is leached with cyanide in a pipe reactor at a pressure of between 5 and 8 MPa. The terminal pH value of the pulp is controlled to be 10 or less than 10.

3 Claims, No Drawings

LEACHING REFRACTORY GOLD ORES

BACKGROUND TO THE INVENTION

This invention relates to the leaching of refractory gold ores.

It is a well known phenomenon that when gold ores are leached with the usual additions of lime that are made to cyanide solutions, the extraction rate is adversely affected by the presence of sulphide minerals of arsenic and antimony as well as base metal cyanicides such as Ni, Cu and Co. It is also known that if the pH of the leach solution is reduced to levels as low as 10, the extraction rate can be increased. However, in order to attain satisfactory recoveries of gold even when leaching at these low pH values, the leaching times may sometimes be inordinately protracted.

The term "ore" is intended to mean not only ores as mined but also dumps, tailings, concentrates and other products emanating from mining operations.

It is an object of the invention to provide a process in which the gold from such a refractory ore could be dissolved, in acceptably short leaching times, with higher recoveries of gold than can be obtained using conventional procedures, for example, those used on the Witwatersrand, South Africa.

SUMMARY OF THE INVENTION

The invention provides a method of leaching a gold ore which is refractory due to the presence of sulphide minerals of arsenic and antimony and base metal cyanicides with a cyanide solution and with oxygen addition characterised by the steps of leaching the ore at a suitable super-atmospheric pressure and regulating the pH value of the solution so that the terminal pH is alkaline and 10 or less than 10.

The essence of the invention is the combination of the concept of low-alkalinity cyanidation with cyanidiation under pressure conditions with oxygen addition, for the treatment of refractory ores.

A pressure of between 2 and 10 MPa has been found to be effective, but it is preferred to work in a range of pressure between 5 and 8 MPa, and preferably with a pipe reactor of the kind described in German patent specification No. 1 937 392, which would not require the use of sophisticated materials of construction.

The process has been found to give good extractions of gold at temperatures between ambient and 60° C., depending on the mineralogy and composition of the material to be leached.

DESCRIPTION OF EMBODIMENTS

Laboratory-scale pressure leaching was carried out at oxygen overpressures of up to 100 bars in a 5 l stainless steel autoclave.

The liquid-to-solid ratios in the slurries that were tested were generally 1 to 1, and a terminal pH value of below 10 units was the target. Cyanide additions were not optimized, since the laboratory-scale autoclave was known not to represent accurately the conditions that exist in a pipe reactor, and the intention was in fact eventually to transfer the technology to the pipe reactor concept.

The cyanide consumption when treating concentrates which contained high base metal contents, were of necessity very large. Additions of up to 50 kg NaCN/t were made in the initial testwork at 60° C., but in later testwork at 20° C. these additions were usually in the range 10–20 kg/t.

The Starting Materials that were used in Bench Scale Tests

Chemical analyses on the different materials that were tested are presented in Table I, which follows. The analysis of a bulk sample of arsenic middlings is the most comprehensive, and it should be noticed that the concentrations of base metals in other materials that are listed, such as the stibnite concentrate and the arsenopyrite concentrate, are much lower than in the arsenic middlings.

TABLE I

COMPOSITION OF HEAD SAMPLES

| ELEMENT | As MIDDLINGS | STIBNITE CONC. | ARSENOPYRITE CONC. | E. TRANSVAAL CONC. |
|---|---|---|---|---|
| Au | 53 g/t | 18,5 g/t | 24,9 g/t | 133,2 g/t |
| As | 5,3% | 0,37% | 35,5% | 4,08% |
| Sb | 28,0% | 61,2% | 0,27% | 0,27% |
| Cu | 0,16% | N.A. | N.A. | 0,17% |
| Co | 0,16% | N.A. | N.A. | 0,054% |
| Ni | 2,56% | N.A. | 0,081% | 0,18% |
| Fe | 6,6% | N.A. | N.A. | 6,0% |
| $SiO_2$ | 10,1% | N.A. | N.A. | N.A. |
| MgO | 10,2% | N.A. | N.A. | N.A. |
| S total | 16,84% | 24,2% | 16,03% | 20,55% |
| S sulphide | 15,70% | N.A. | 15,22% | 19,76% |
| Ca | 0,30% | N.A. | N.A. | N.A. |
| Cl | 0,01% | N.A. | N.A. | N.A. |

N.A. = Not Available

Bench-scale Low-Alkalinity Pressure Leaching

Results of testwork in the laboratory-scale autoclave appear in Tables II, III, IV and V where conditions of low-alkalinity were maintained. Lime additions were arranged so that the terminal pH values were always less than 10 units. For comparative purposes, tests whose numbers are marked with an asterisk (*) were conducted at pH values of between 12 and 12,5 units, as in conventional cyanidation procedures.

TABLE II

BENCH SCALE CYANIDATION OF ARSENIC MIDDLINGS

| TEST NO. | PRESSURE MPa | TEMP. °C. | TIME MINS. | NaCN ADDITION kg/t | CONSUMED kg/t | Au DISSOLUTION % |
|---|---|---|---|---|---|---|
| 1 | 5,0 | 60 | 120 | 10 | 9,6 | 60,3 |
| 2 | 5,0 | 60 | 120 | 20 | 19,6 | 72,3 |
| 3 | 10,0 | 60 | 120 | 20 | 19,2 | 76,6 |
| 4 | 8,0 | 20 | 15 | 15 | 10,9 | 46,9 |
| 5 | 8,0 | 20 | 30 | 15 | 11,2 | 52,1 |
| 6 | 8,0 | 20 | 60 | 15 | 9,9 | 60,6 |
| 7 | 8,0 | 20 | 100 | 15 | 14,7 | 68,4 |
| 8 | 0,1 | 20 | 24 hrs. | 15 | 14,8 | 42,6 |
| 9* | 5,0 | 20 | 120 | 50 | 49,5 | 5,2 |
| 10* | 5,0 | 60 | 120 | 50 | 45,4 | 3,4 |
| 11* | 0,1 | 20 | 96 hrs. | 20 | N.A. | Trace |

In test 11, where the pH value was between 12 and 12,5 in an ambient cyanidation, the leach solutions were bright orange in colour, and on standing a precipitate formed. In tests 9 and 10, the precipitate presumably formed in the autoclave, as solutions that were pale in colour were produced.

It is noteworthy that cyanidation under ambient conditions, when carried out for four days at the degree of alkalinity that is conventionally employed, yielded a negligible recovery of gold. Ambient cyanidation even with low alkalinity dissolved only 42,6% of the gold (test 8) compared with a dissolution of 76,6% at 10 MPa in 2 hours (test 3).

TABLE III

BENCH SCALE CYANIDATION OF STIBNITE CONCENTRATE

| TEST NO. | PRESSURE MPa | TEMP. DEGREES C. | TIME MINS. | NaCN ADDITION kg/t | NaCN CONSUMED kg/t | Au DISSOLUTION % |
|---|---|---|---|---|---|---|
| 12 | 5,0 | 60 | 120 | 20 | 18,9 | 91,9 |
| 13 | 5,0 | 20 | 15 | 15 | 4,5 | 72,7 |
| 14 | 5,0 | 20 | 30 | 15 | 5,6 | 87,1 |
| 15 | 5,0 | 20 | 60 | 15 | 5,2 | 91,4 |
| 16 | 8,0 | 20 | 30 | 10 | 4,2 | 82,8 |
| 17 | 8,0 | 20 | 60 | 10 | 4,5 | 90,7 |
| 18 | 0,1 | 20 | 72 hrs. | 10 | 8,4 | 61,5 |
| 19* | 5,0 | 20 | 120 | 20 | 0,8 | 8,1 |

High-alkalinity cyanidation at 5 MPa gave a dissolution of 8,1% (test 19*) which is considerably less than the dissolution provided by low-alkalinity cyanidation under ambient conditions (test 18). The best dissolution recorded on this material was 91,9%, provided by low-alkalinity cyanidation at 5,0 MPa for 2 hours (test 12).

TABLE IV

BENCH-SCALE CYANIDATION OF ARSENOPYRITE CONCENTRATE

| TEST NO. | PRESSURE MPa | TEMP. DEGREES C. | TIME MINS. | NaCN ADDITION kg/t | NaCN CONSUMED kg/t | Au DISSOLUTION % |
|---|---|---|---|---|---|---|
| 20 | 5,0 | 60 | 120 | 20 | 12,6 | 69,8 |
| 21 | 5,0 | 20 | 120 | 20 | 1,8 | 68,5 |
| 22 | 5,0 | 20 | 120 | 10 | 2,1 | 69,5 |
| 23 | 5,0 | 20 | 120 | 3 | 0,9 | 68,3 |
| 24* | 5,0 | 20 | 120 | 10 | 0,8 | 62,7 |

It is stated on the literature that the presence of arsenopyrite has little effect on gold dissolution by cyanidation. The dissolution under conditions of higher alkalinity (test 24*) are only slightly lower than those in the other tests in the series. Orpiment ($As_2S_3$) on the other hand, has much the same effect as stibnite ($Sb_2S_3$). It can be inferred that little if any orpiment was present in this case.

TABLE V

BENCH-SCALE PRESSURE CYANIDATION ON THE E. TRANSVAAL CONCENTRATE

| TEST NO. | PRESSURE MPa | TEMP. DEGREES C. | TIME MINS. | NaCN ADDITION kg/t | NaCN CONSUMED kg/t | Au DISSOLUTION % |
|---|---|---|---|---|---|---|
| 25 | 5,0 | 20 | 2 | 10 | 5,6 | 63,4 |
| 26 | 5,0 | 20 | 2 | 20 | 8,1 | 65,4 |
| 27 | 0,1 | 20 | 24 | 10 | 9,4 | 63,7 |
| 28 | 0,1 | 20 | 24 | 20 | 17,4 | 63,8 |
| 29* | 5,0 | 20 | 2 | 20 | N.A. | 51,0 |

This concentrate contains pyrite and arsenopyrite so the results are essentially similar to the previous case. Nevertheless a significant difference was noted between the results of low-alkalinity cyanidation (test 29*) and high-alkalinity cyanidation (tests 25 to 28). For some reason the application of pressure showed little effect on recorded dissolutions, but the fact that the dissolution under conditions of pressure combined with low-alkalinity is achieved in only 2 hours rather than 24 hours under ambient conditions is of extreme economic importance.

Full-Scall Testwork in a Pipe Reactor

Full-scale testwork was effected in a 100 mm diameter, 4,0 km long pipe reactor. The capacity in continuous operation of this installation which can operate at 150° C. and 5 MPa, is 40 000 tonnes of feed per month.

The results of the testwork using direct pressure cyanidation on a 250 tonne sample of arsenic middlings material are described. The stockpile of arsenic middlings at the mine is known to be extremely variable; this is demonstrated by the fact that the gold and base metal contents as shown in Table VI are very different from the values in Table I which is the analysis of the same type of material used in the small-scale testwork.

TABLE VI

CHEMICAL ANALYSIS OF ARSENIC MIDDLINGS FOR TESTWORK IN THE PIPE REACTOR

| ELEMENT | CONCENTRATION |
|---|---|
| Au | 22,7 g/t |
| Sb | 22,9% |
| As | 2,13% |
| Cu | 0,11% |
| Fe | 3,3% |
| Co | 0,08% |
| Ni | 1,22% |
| Total S | 10,47% |
| Sulphide S | 9,40% |

Direct Pressure Cyanidation in the Pipe Reactor

Table VII shows the results of a run using direct pressure cyanidation in the pipe reactor.

TABLE VII

DIRECT PRESSURE CYANIDATION OF ARSENIC MIDDLINGS IN THE PIPE REACTOR

| | |
|---|---|
| Test No. | 37 |
| Retention time per pass | 40 mins. |
| Inlet pressure | 4,8 MPa |
| Outlet pressure | 3,2 MPa |
| S.G. of pulp | 1,3 |
| Temperature | Ambient |
| Throughput | 47 $m^3$/hr |
| NaCN addition | 10 kg/t |
| Terminal pH value | 10 units |
| Pipe length | 4,0 km |
| Pipe diameter | 100 mm |
| Au extr. after 2 passes | 80,6% |
| Au extr. after 3 passes | 90% |

Conclusion from the testwork

An examination of the results shows that the benefits that result from low-alkalinity cyanidation under pressure are far greater when stibnite rather than arsenopyrite is the major constituent. Tables II and III show the extractions at high alkalinity on stibnite-bearing materials were very much lower than those in which the pH values were 10 units or less. Tables IV and V on the other hand, indicate a smaller difference when the stibnite content was low, but significant concentration of arsenopyrite were present. Nevertheless, the improvement in gold recovery in the latter case is of economic significance.

The application of an oxygen overpressure in cyanidation increases the rates of the reactions that take place during the dissolution of gold. At a pressure of 5 MPa the increase in the partial pressure of oxygen is some 250 times greater than under ambient conditions with air. Efficient mixing is essential to ensure that dissolved oxygen contacts gold surfaces.

An aspect which is very important is the marked increase in dissolution that is possible with the use of a pressurized pipe reactor. Although the samples are not the same, Table II shows that in the laboratory stirred autoclave gold dissolutions of only about 70% could be obtained from arsenic middlings, where in the pressurized pipe reactor, recoveries of 90% were possible, as indicated in Table VII.

The fact that the dissolution that were obtained on arsenic-rich concentrates were lower than those on stibnite concentrate is not surprising when it is realized that there is a far greater tendency for the particular mineralogical situation that exists for gold to be locked in arsenopyrite, and not in stibnite. Detailed examination using a microprobe has shown in fact that over 20% of the gold occuring in the arsenopyrite is locked, but in the stibnite concentrate, 95% of it is free. Fine milling prior to pressure cyanidation would seem to be the obvious way to improve gold dissolutions from the arsenopyrite concentrate.

We claim:

1. A method of leaching a gold ore which is refractory due to the presence of sulphide minerals of arsenic and antimony and base metal cyanicides with a cyanide solution and with oxygen addition characterised by the steps of leaching the ore at a pressure of between 2 and 10 MPa and regulating the pH of the solution so that the terminal pH is alkaline and 10 or less than 10.

2. The method claimed in claim 1 in which the pressure is in the range 5 to 8 MPa.

3. The method claimed in claim 2 in which low alkalinity cyanidation is carried out in a pipe reactor.

* * * * *